United States Patent [19]

Granbom

[11] Patent Number: 4,960,037

[45] Date of Patent: Oct. 2, 1990

[54] APPARATUS IN PRESSURIZED FLUID CYLINDERS NOT HAVING PISTON RODS

[76] Inventor: Bo Granbom, Södergatan 5, S-736 00 Kungsör, Sweden

[21] Appl. No.: 313,476

[22] Filed: Feb. 22, 1989

[30] Foreign Application Priority Data

Mar. 14, 1988 [SE] Sweden ..... 8800908

[51] Int. Cl.[5] ..... F01B 29/00

[52] U.S. Cl. ..... 92/88; 92/165 R

[58] Field of Search ..... 92/88, 165 R; 244/63; 277/DIG. 7

[56] References Cited

U.S. PATENT DOCUMENTS 3,454,242 7/1969 Feder et al. ..... 92/88
4,664,019 5/1987 Lipinski ..... 92/88
4,685,383 8/1987 Ruchser ..... 92/88
4,852,465 8/1989 Rosengren ..... 92/88
4,856,415 8/1989 Noda ..... 92/88

*Primary Examiner*—Edward K. Look
*Assistant Examiner*—Thomas Denion
*Attorney, Agent, or Firm*—Cushman, Darby & Cushman

[57] ABSTRACT

Apparatus in pressurized fluid cylinders where the piston is provided with a dog (2) extending through a slit in the cylinder wall, the slit being closed off with the aid of a sealing strip. The invention is distinguished in that a support part (4) which is fixed along the cylinder (1) has two free opposing surfaces (7) disposed at the side of the dog (2) and parallel to its path of movement and in that the dog (2) is provided with a portion (8) with two surfaces each of which is in slideable engagement with one of the surfaces (7) of the support part (4).

4 Claims, 2 Drawing Sheets

APPARATUS IN PRESSURIZED FLUID CYLINDERS NOT HAVING PISTON RODS

BACKGROUND OF THE INVENTION

The present invention relates to apparatus in such pneumatic cylinders, "Origa Cylinders", where the piston is provided with a laterally directed dog projecting through a slit in the cylinder wall, the dog moving along the slit under the action of the pneumatic pressure acting on the piston. The slit is closed off and sealed towards the interior of the cylinder with the aid of a sealing strip.

The function of such cylinders can be regarded as well-proven and satisfactory. However, there is a disadvantage in that due to its design the dog extends out through a relatively narrow slit, resulting in that the apparatus can only take up limited skew loads, i.e. forces with components transverse the direction of movement of the dog. Attempts have been made to solve these problems and provide the apparatus with greater ability to take up forces by mounting different forms of support rails on either side of the slit. This has been found to be less suitable, however, due to the sides of the slit moving in relation to each other in response to the excess pressure inside the cylinder. This means that the support surfaces also move in relation to each other. Another solution uses a guide attached along the side of the cylinder and with a width corresponding to the cylinder diameter. The two opposing long sides of the guide are prismatically shaped and guide a runner moving on the guide, this runner being used to attach the components which are to be driven by the apparatus. The dog is attached to one side edge of the runner. Due to its design, this apparatus will be relatively voluminous, and the force from the piston is to be transmitted via the dog to the runner, which constitutes the part taking up force. This further means that the piston itself is subjected to skew loads, even for purely axial loading moments, due to the moment caused by the design.

SUMMARY OF THE INVENTION

By means of the present invention, the problem with unloading the dog from load moments with force components acting at right angles to the direction of movement of the dog is solved in a very simple way. The invention provides a configuration requiring small space and relatively small costs.

BRIEF DESCRIPTION OF THE DRAWINGS

The invention will now be described in more detail in the form of examples and with reference to the drawing, where.

DETAILED DESCRIPTION OF THE PRESENTLY PREFERRED EXEMPLARY EMBODIMENTS

Figure 3:
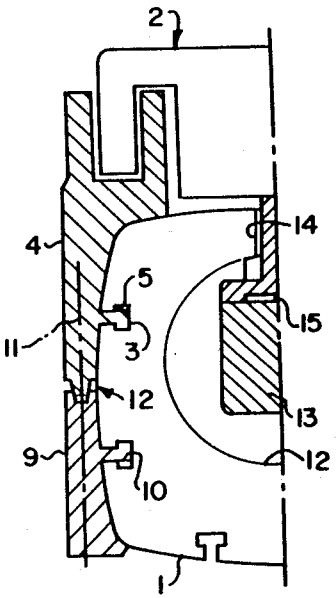
FIG. 3 is a modified form of the invention schematically illustrated in section.
Figure 1:
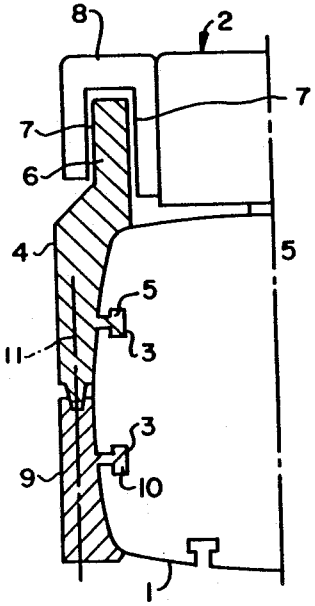
FIG. 1 is a half section through a schematically indicated cylinder provided with the dog and the inventive apparatus.
Figure 3A:
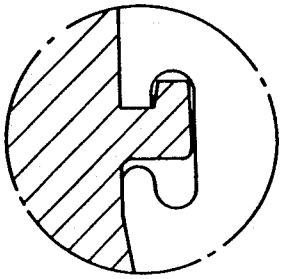
FIG. 3A shows, on a larger scale, the portion circled in FIG. 3.
Figure 2:
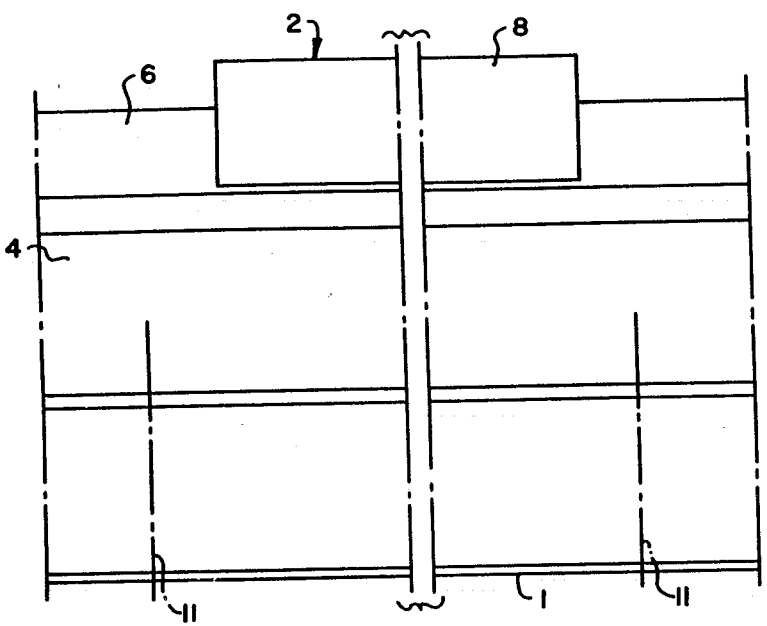
FIG. 2 is a schematic, partial side view (with the end portions also excluded) of the arrangement in FIG. 1.
Figure 4:
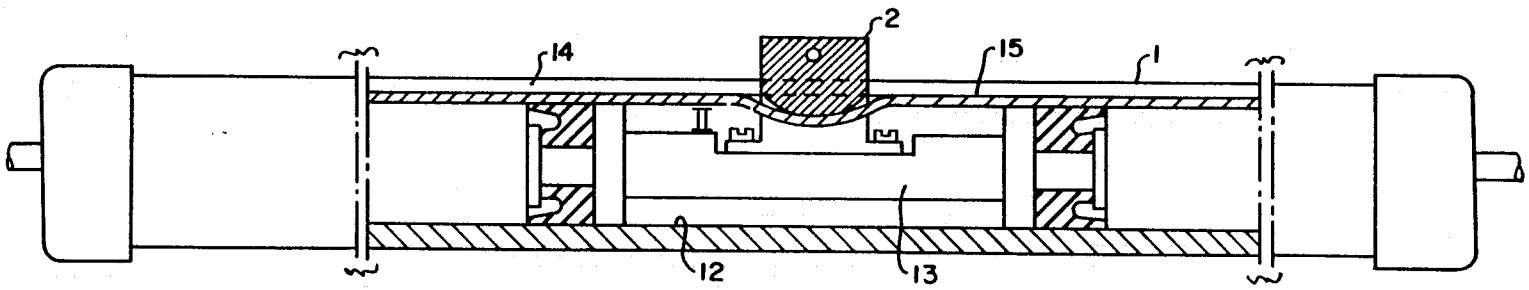
FIG. 4 (PRIOR ART)
FIG. 4 is a side elevational view of a prior art cylinder of the type with which the present invention is concerned, showing in longitudinal section, a typical appearance of the relationship of the cylinder bore, slit, slidable piston and sealing strip to other structure.

The numeral 1 denotes the very schematical configuration of the cylinder not having a piston rod (the cylinder bore 12, slit 14, piston 13 and sealing strip 15 are shown schematically only in FIGS. 3 and 4, since they can be regarded as being the same in the cylinder of the present invention, as in the prior art). The numeral 2 denotes the part of the dog which is outside the cylinder. The illustrated cylinder has a nearly square section with rounded corners and arcuate sides, with pairs of T slots 3 made on three of the sides. The shape of the slots 3 in the illustrated example will be clearly seen from FIG. 1. A supporting portion 4 is provided with a profiled rail 5 integral with it and having a configuration complementary to that of the T slot 3. The side from which the rail 5 extends, and which is facing towards the cylinder shell has cylinder shell has a configuration complementary to that of the shell. The support part 4 has a principly rectangularly shaped flange 6, the parallel sides of which form two opposing surfaces 7 extending along the entire movement range of the dog 2. The dog 2 is also provided with a yoke 8 surrounding the flange 6 and having two surfaces in slidable engagement with the surfaces 7 of the flange 6. A profile 9 is provided, as with the support part 4, with a profiled rail 10 having a cross-sectional shape corresponding to that of the T slot 3. The side facing towards the cylinder shell carrying the rail 10 has a configuration complementary to that of the cylinder shell.

The support part 4 is attached to the cylinder by its being inserted axially with the rail 5 in the slot 3. The profile 9 with its rail 10 is inserted axially in the other slot 3 in the same way. When the support part 4 and the profile 9 are in place, these parts are urged towards each other with the aid of screws, indicated by the numeral 11 and disposed at an even pitch along the parts. The (unillustrated) screws pass through bores in the profile 9 and co-act with threaded holes in the support part 4.

Irrespective of the radial movements of the cylinder shell in the region of the slit, due to interior excess pressure, the dog 2 will always be able to be supported against the support flange 6, which is capable of taking up load movements with force components deviating from the purely axial direction. Torques acting on the dog at right angles to its direction of movement are also taken up via the yoke 8 by the flange 6.

Within the scope of the invention it is of course possible to vary components and details therein, e.g. the edges facing towards each other of the part 4 and the profile 9 can be provided with tongues and grooves 12 for taking up, together with the screws 11, any bending movements which can occur during assembly and for extreme loads on the yoke 2, see FIG. 3. In the latter figure there is also illustrated a possible, modified embodiment, where the support part 4 has two rails or one "yoke portion" and the dog 2 has a flange, slidingly co-acting with the inner surfaces of the rails or yoke portion. FIG. 3 also shows the profiled rails 5 and 10 configurated as hooks in cross section, these hooks engaging the T slot 3. This implementation can facilitate assembly of the support part 4 and profile 9.

I claim:

1. An apparatus comprising:

a cylinder device having a longitudinal axis and a cylindrical wall, said cylindrical wall having a slit defined therethrough and at least one longitudinally extending slot defined in an outside surface thereof, said at least one slot being parallel to a longitudinal axis of said cylinder;

a slidable piston disposed within said cylinder, said piston having a longitudinal axis;

a dog for said piston, said dog extending through said slit in said cylindrical wall;

said dog having an engagement portion defined longitudinally thereof, said engagement portion having at least first and second engagement surfaces defined in planes which are laterally offset from a plane containing said slit and said longitudinal axis of said piston;

a sealing strip for sealing said slit; and a support part having at least one longitudinally extending rail element disposed in a slot in the outside surface of the cylindrical wall so that said support part is radially fixed with respect to said cylinder device, said support part further including an engaging portion, said engaging portion including at least first and second engaging surfaces, said engaging surfaces of said engaging portion of said support part being parallel to respective engagement surfaces of said engagement portion of said dog.

2. An apparatus as in claim 1, wherein said engaging surfaces of the support part are defined in first and second planes which are parallel to one another, said planes being parallel to a plane containing the dog and the longitudinal axis of the piston.

3. An apparatus as in claim 2, wherein engaging surfaces of the support part are first and second side surfaces of a rectangular flange, said engagement portion of the dog being substantially U-shaped, the rectangular flange being slidably received between the legs of the U-shaped engagement portion.

4. An apparatus as claimed in claim 1, wherein said at least one slot defined in the outside surface of said cylindrical wall is T-shaped, the trail of the support part being disposed in a T-shaped slot disposed nearest the dog and further comprising a profile element having a profiled rail configured to engage a second T-shaped slot adjacent the T-shaped slot of the support part and means for urging said profile element and said support part towards one another thereby fastening said support part to said cylindrical wall.

* * * * *